US010724170B2

(12) United States Patent
Lee et al.

(10) Patent No.: US 10,724,170 B2
(45) Date of Patent: Jul. 28, 2020

(54) LAUNDRY TREATING APPARATUS

(71) Applicant: LG Electronics Inc., Seoul (KR)

(72) Inventors: Haewoong Lee, Seoul (KR); Seonghwan Kim, Seoul (KR); Jinwoo Bae, Seoul (KR)

(73) Assignee: LG Electronics Inc., Seoul (KR)

( * ) Notice: Subject to any disclaimer, the term of this patent is extended or adjusted under 35 U.S.C. 154(b) by 201 days.

(21) Appl. No.: 15/663,079

(22) Filed: Jul. 28, 2017

(65) Prior Publication Data

US 2018/0347103 A1 Dec. 6, 2018

(30) Foreign Application Priority Data

Jun. 2, 2017 (KR) ..... 10-2017-0068997

(51) Int. Cl.

| | |
|---|---|
| ***F26B 25/06*** | (2006.01) |
| ***D06F 58/30*** | (2020.01) |
| ***D06F 29/00*** | (2006.01) |
| ***D06F 58/10*** | (2006.01) |
| ***D06F 58/04*** | (2006.01) |
| ***F26B 13/10*** | (2006.01) |

(Continued)

(52) U.S. Cl.

CPC ..... *D06F 58/30* (2020.02); *D06F 29/005* (2013.01); *D06F 58/04* (2013.01); *D06F 58/10* (2013.01); *F26B 13/10* (2013.01); *D06F 21/00* (2013.01); *D06F 29/00* (2013.01); *D06F 58/00* (2013.01)

(58) Field of Classification Search

CPC ..... D06F 58/28; D06F 58/04; D06F 58/10; D06F 58/00; D06F 29/005; D06F 29/00; D06F 21/00; F26B 13/10

USPC ..... 34/202, 209, 210, 211, 212, 443, 389, 34/390

See application file for complete search history.

(56) References Cited

U.S. PATENT DOCUMENTS 4,644,136 A * 2/1987 Watchman ..... A47K 10/06 219/385
5,369,892 A * 12/1994 Dhaemers ..... D06F 58/10 34/224

(Continued)

FOREIGN PATENT DOCUMENTS

| | | |
|---|---|---|
| EP | 1959050 | 8/2008 |
| JP | 1990119900 | 5/1990 |

(Continued)

OTHER PUBLICATIONS

Extended European Search Report in European Application No. 17182170.5, dated Oct. 18, 2017, 9 pages (with English translation).

*Primary Examiner* — John P McCormack
(74) *Attorney, Agent, or Firm* — Fish & Richardson P.C.

(57) ABSTRACT

A laundry treating apparatus includes an accommodating body, a dry chamber that is mounted in the accommodating body and spaced apart from the accommodating body by a preset distance, a rack provided in the dry chamber and configured to receive objects to be dried, an air inlet hole defined at a rear surface of the accommodating body, an air supply unit configured to supply heated air through the air inlet hole toward a space defined between the accommodating body and the dry chamber, and an air supply hole defined at a chamber front and allowing flow of air from the accommodating body to the dry chamber through the air supply hole.

20 Claims, 15 Drawing Sheets

(51) Int. Cl.
*D06F 21/00* (2006.01)
*D06F 58/00* (2020.01)

(56) References Cited

U.S. PATENT DOCUMENTS

| | | | | |
|---|---|---|---|---|
| 6,928,752 | B2 * | 8/2005 | Johnson | D06F 29/005 34/109 |
| 6,973,740 | B2 * | 12/2005 | Meyer | D06F 58/10 34/202 |
| 8,119,070 | B2 * | 2/2012 | Zimmerman | D06F 58/203 34/218 |
| 9,562,310 | B2 * | 2/2017 | Han | D06F 29/00 |
| 2007/0151120 | A1 * | 7/2007 | Tomasi | D06F 29/00 34/601 |
| 2012/0055039 | A1 * | 3/2012 | Watson | D06F 58/10 34/218 |

FOREIGN PATENT DOCUMENTS

| | | |
|---|---|---|
| JP | 2001113098 | 4/2001 |
| KR | 1020050098574 | 11/2005 |
| KR | 1020100060889 | 6/2010 |
| KR | 1020130093153 | 8/2013 |
| WO | 2008123698 | 10/2008 |
| WO | 2016037873 | 3/2016 |
| WO | WO2016070896 | 5/2016 |

* cited by examiner

[Fig. 1]
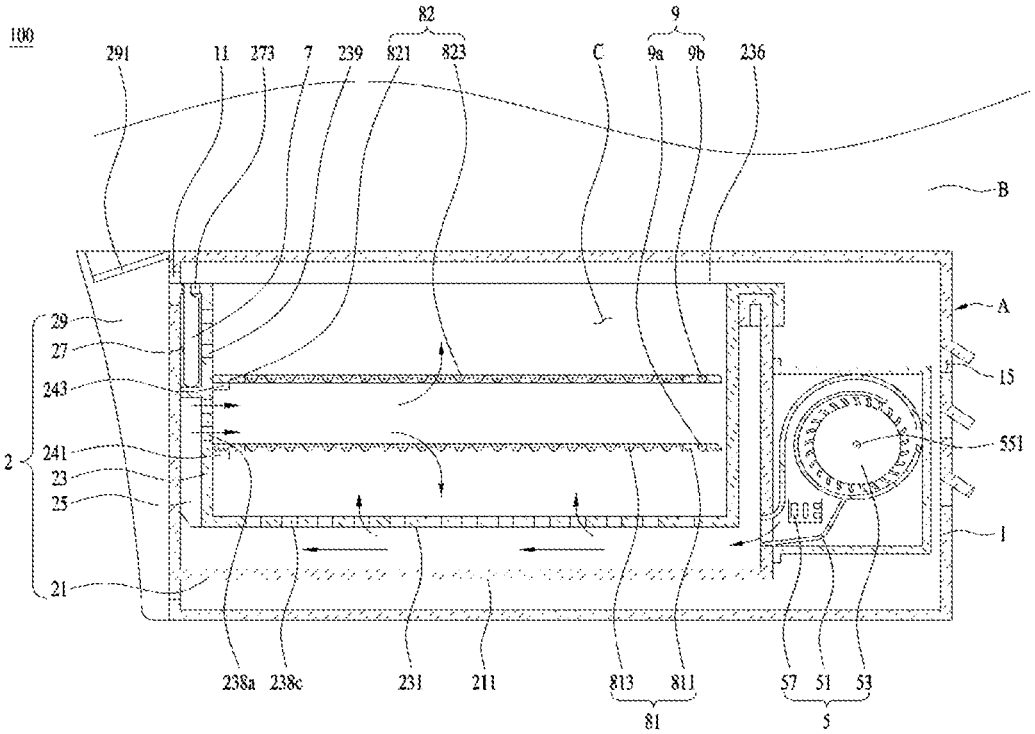

[Fig. 2]
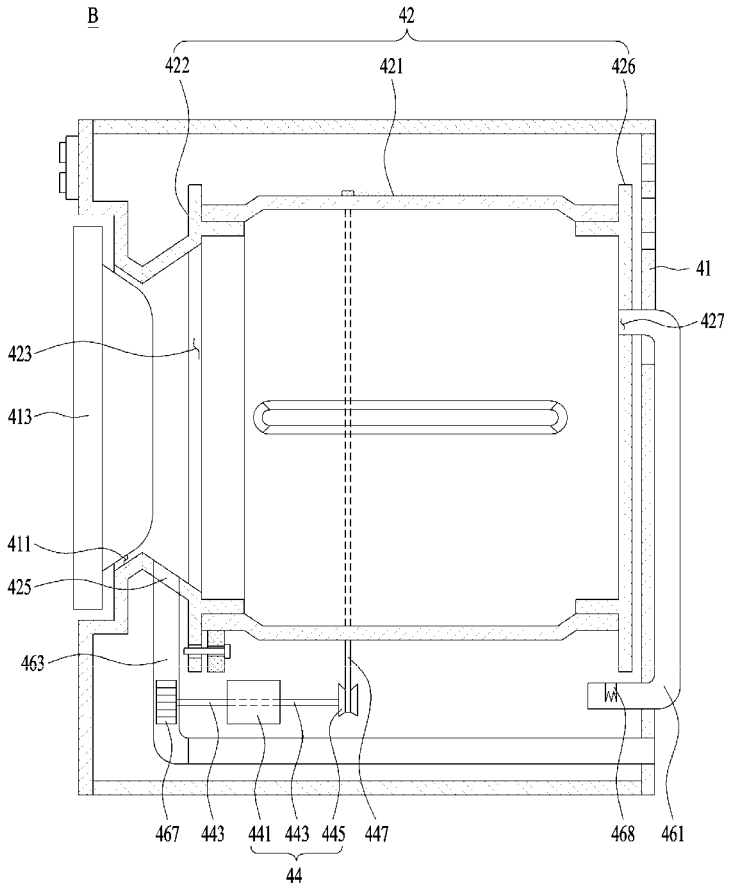

[Fig. 3]
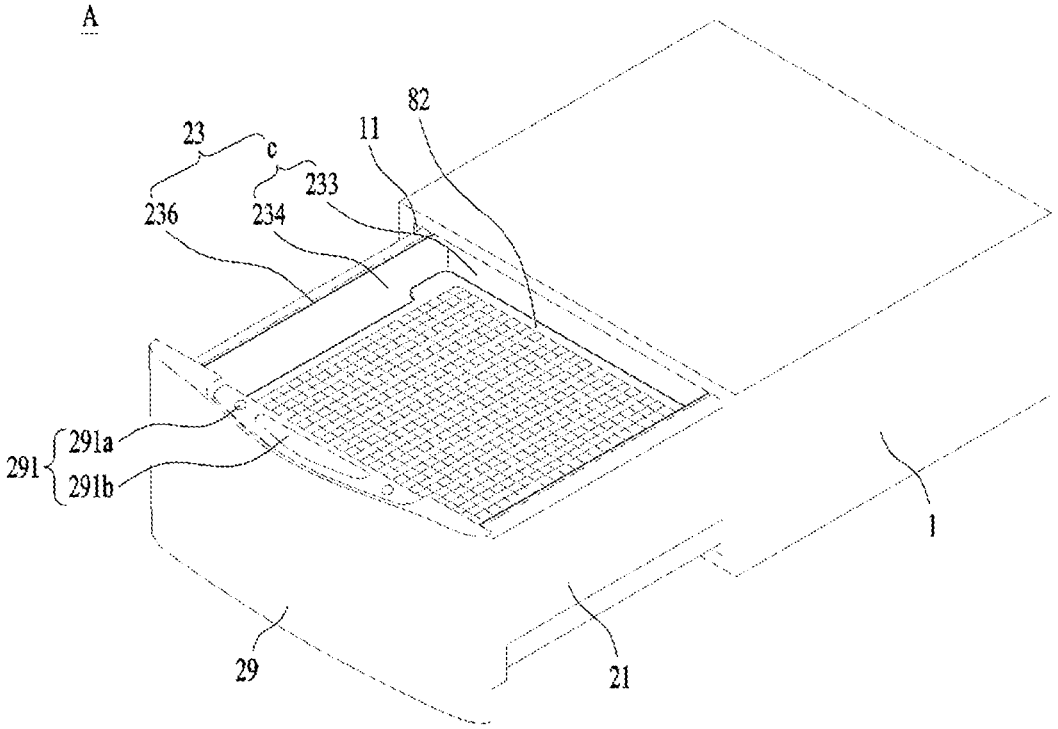

[Fig. 4]
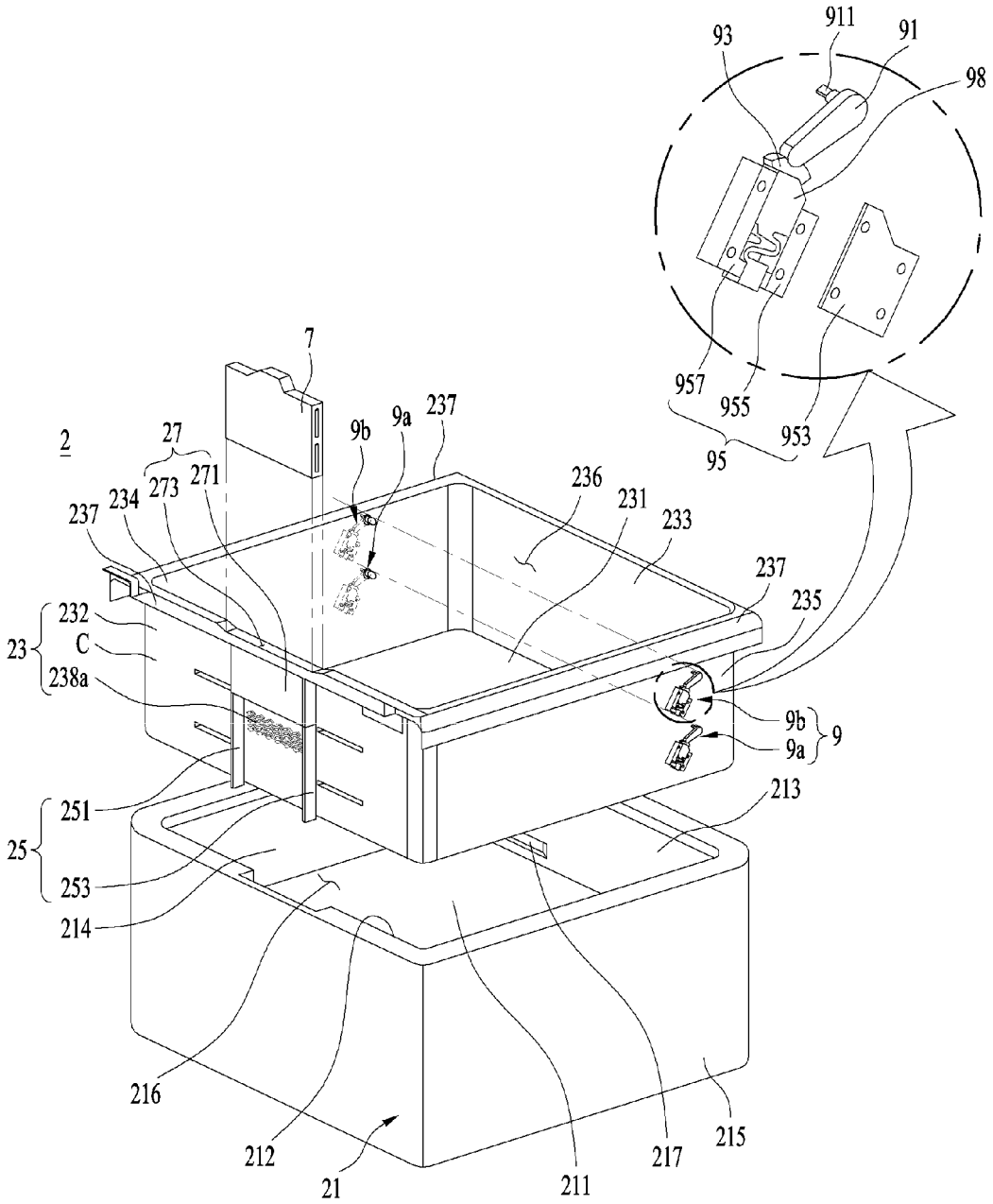

[Fig. 5]
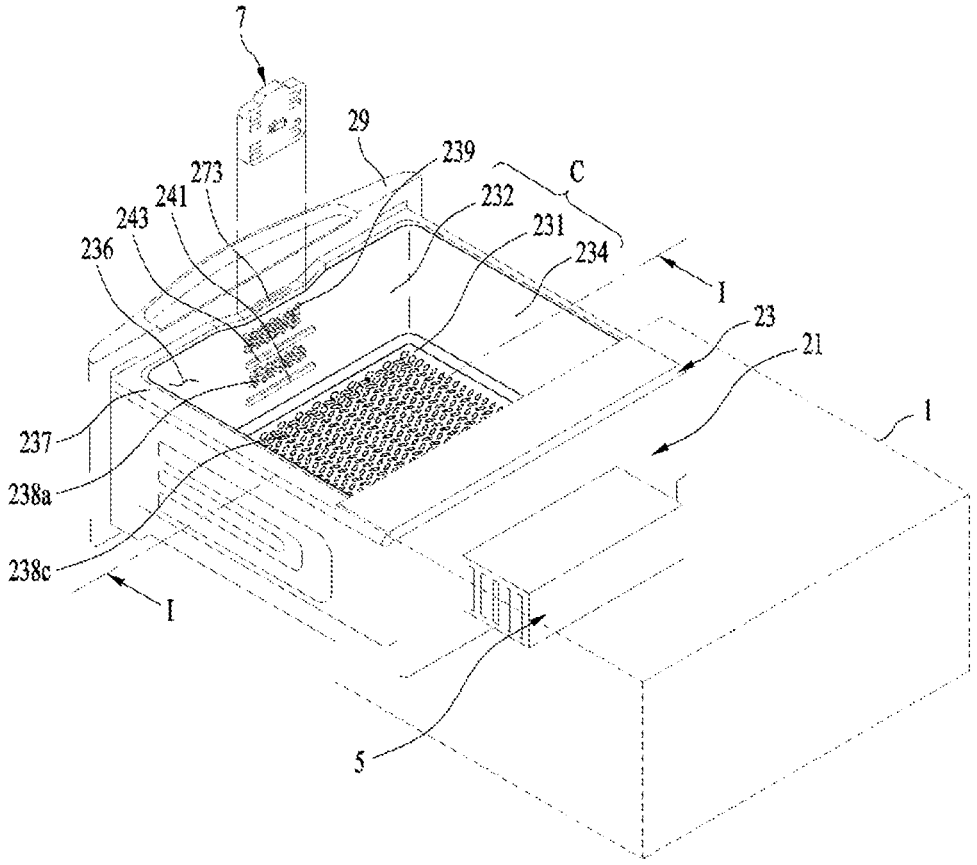

[Fig. 6]
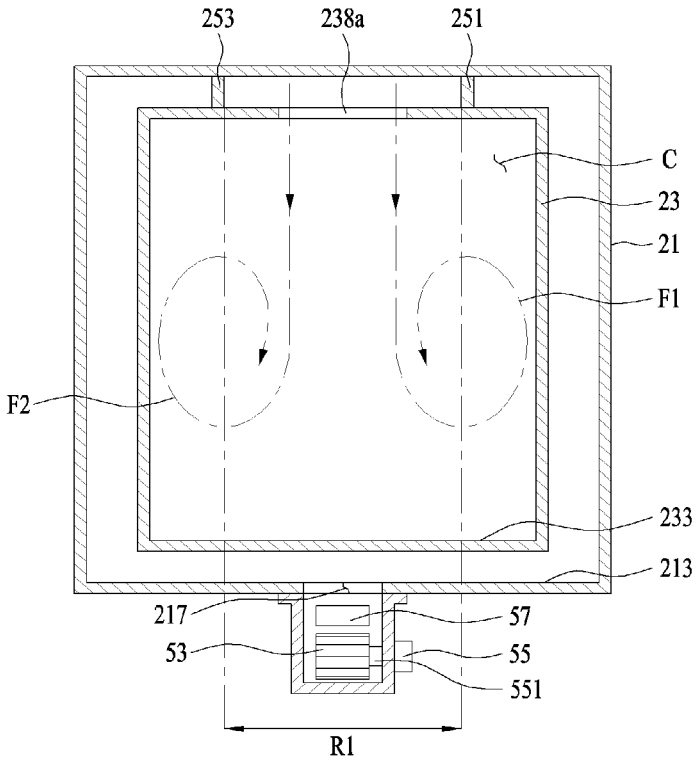

[Fig. 7]
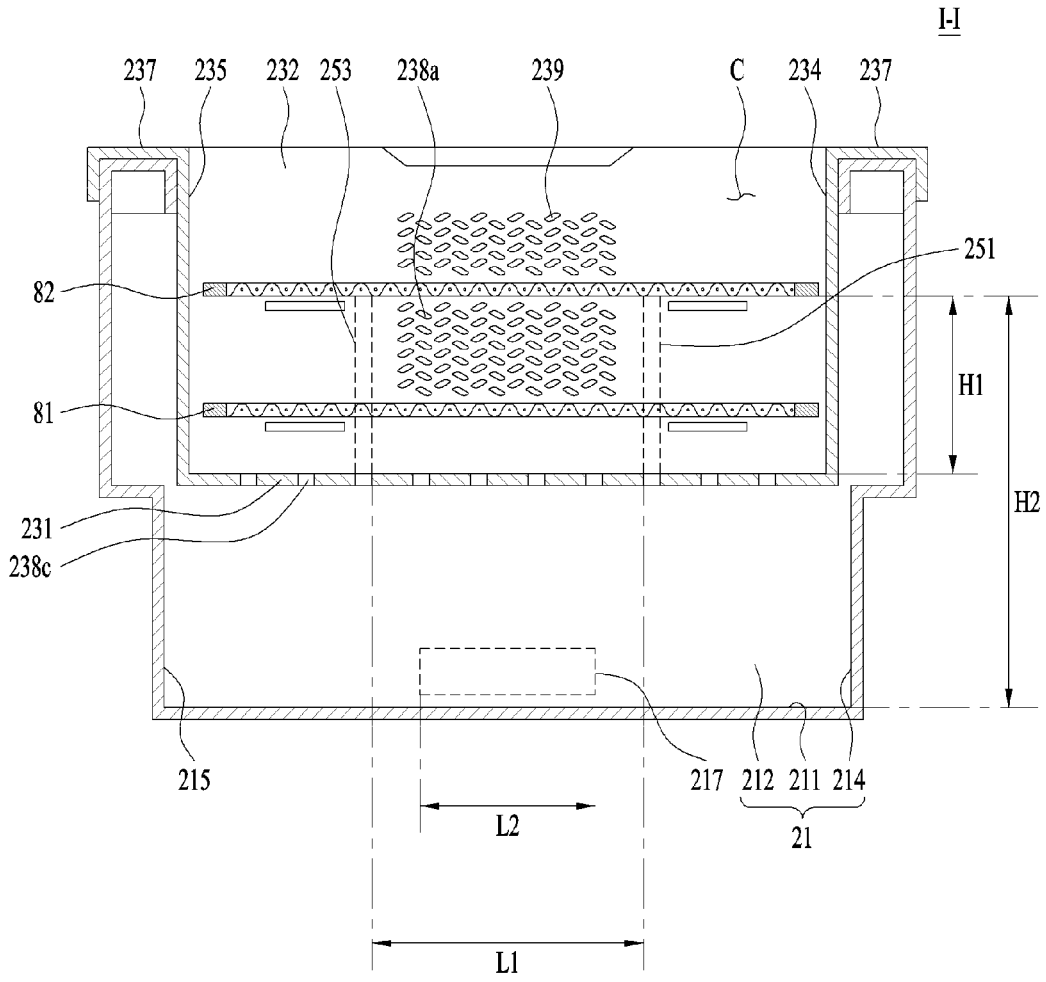

[Fig. 8]
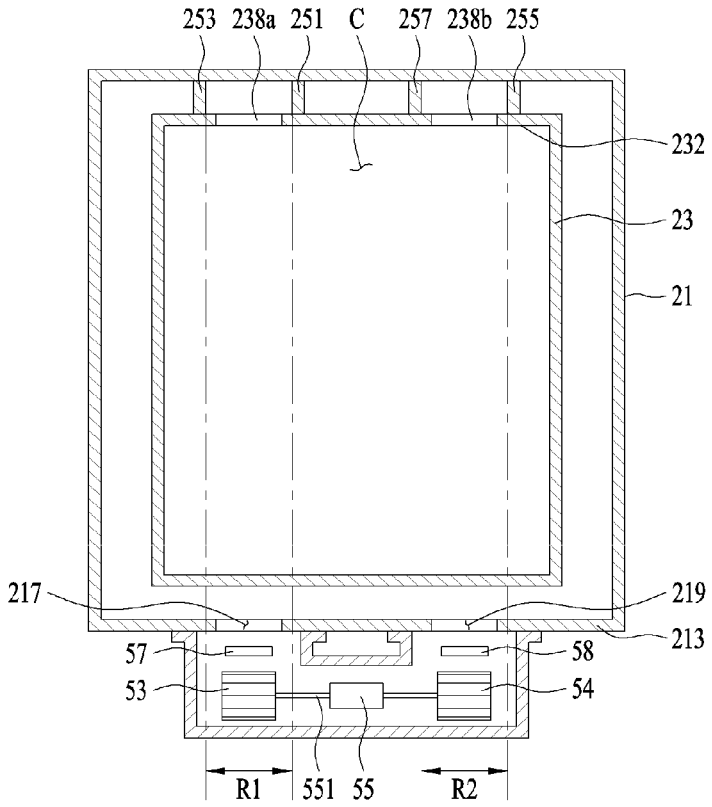
[Fig. 9]
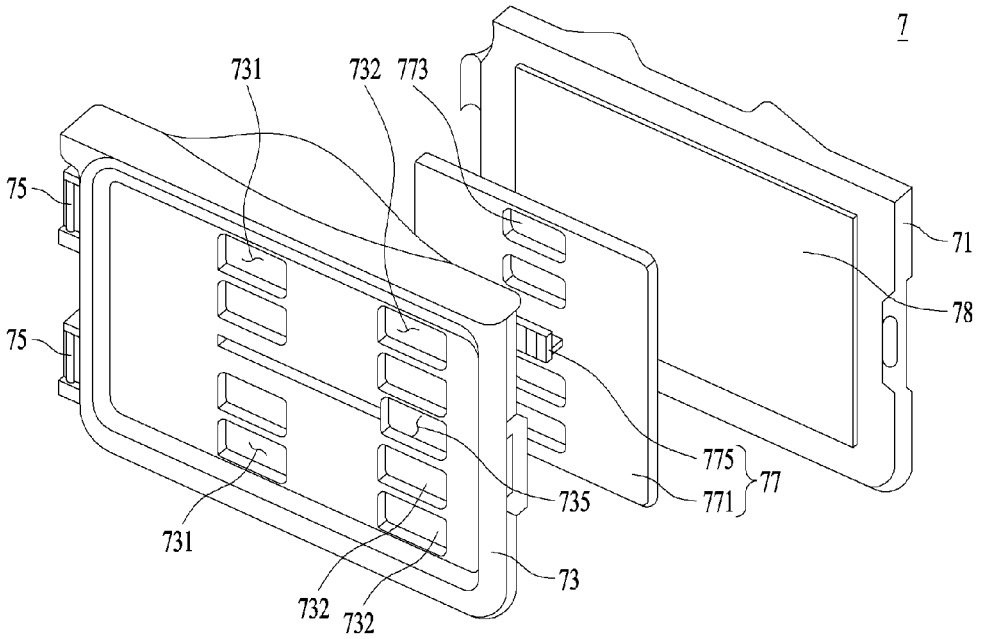

[Fig. 10]
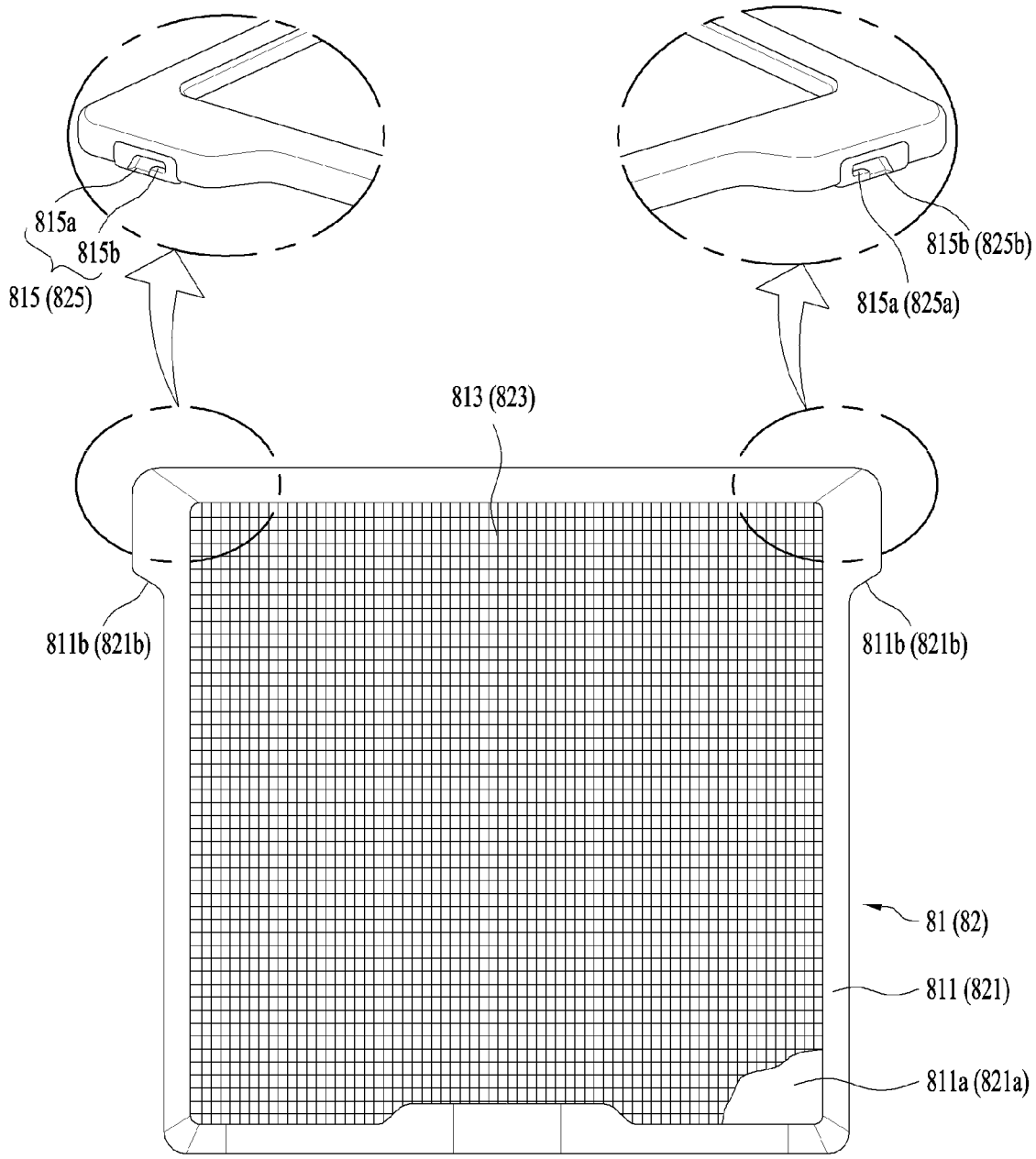

[Fig. 11]
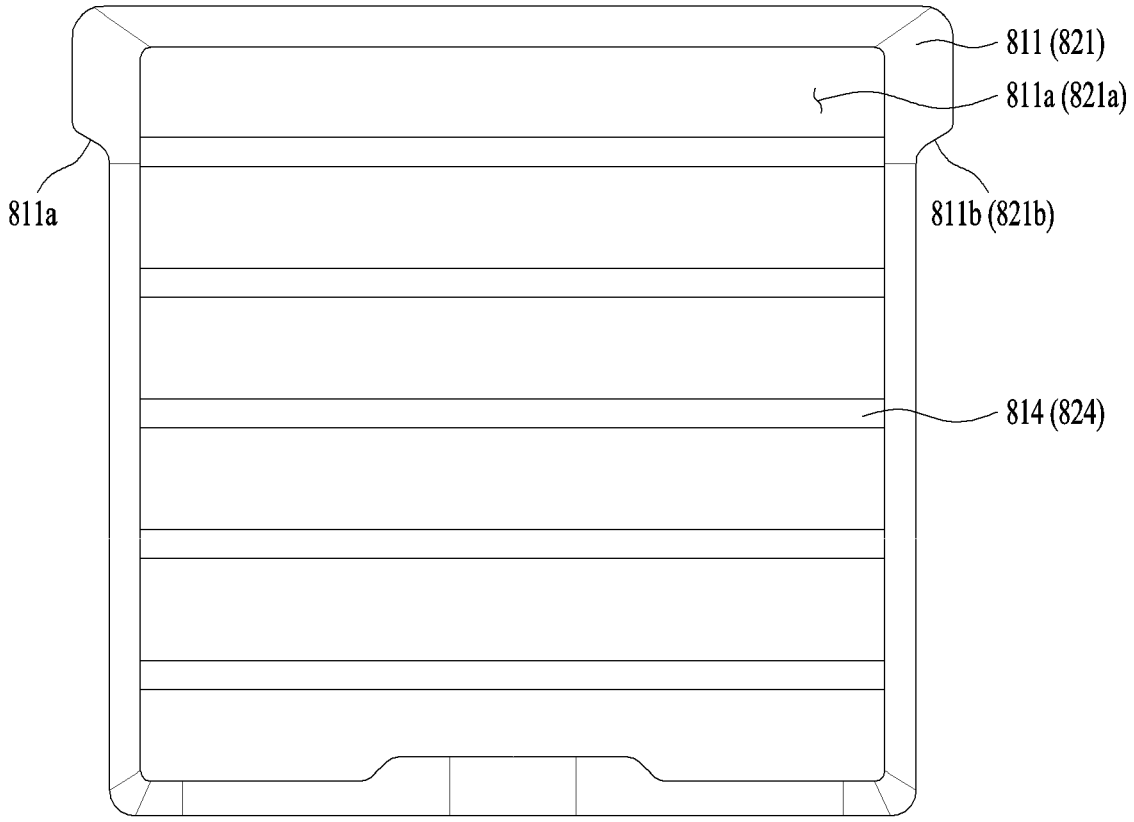

[Fig. 12]
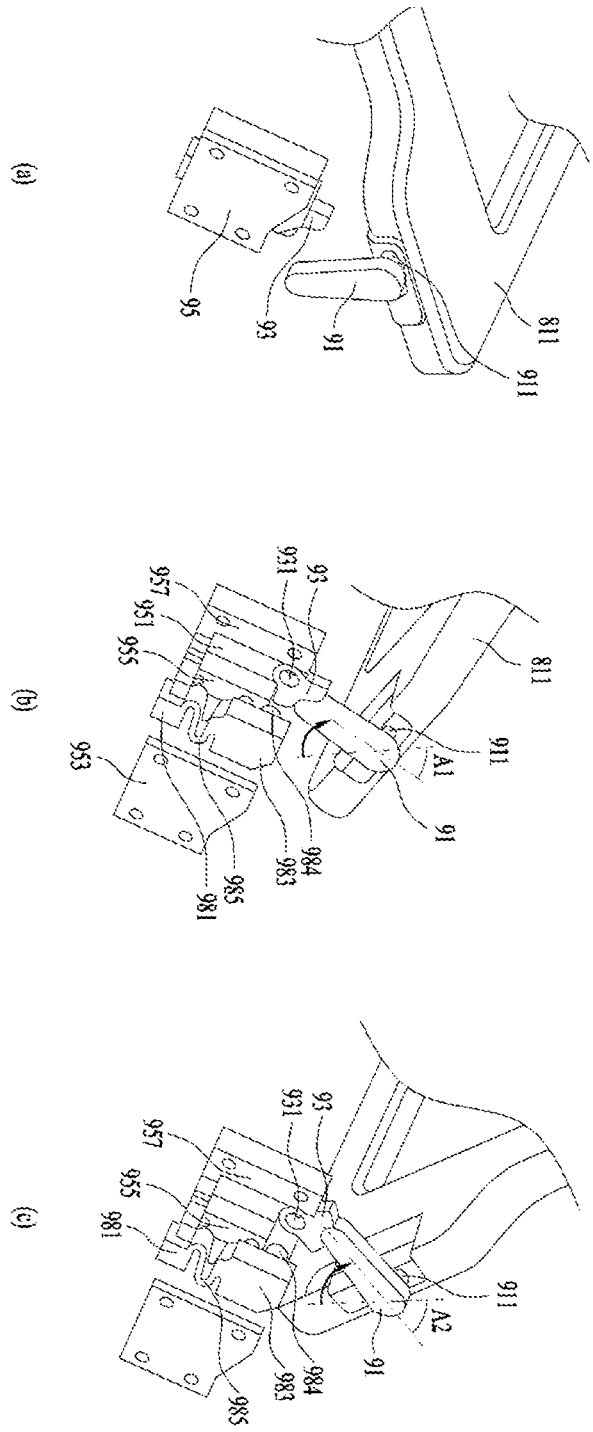

[Fig. 13]
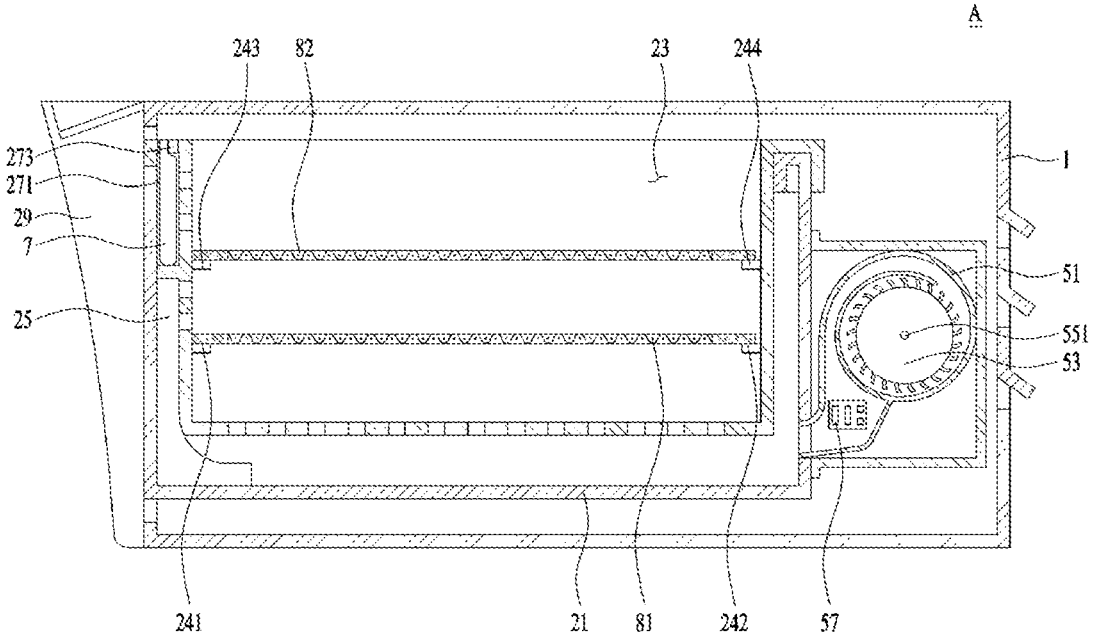

[Fig. 14]
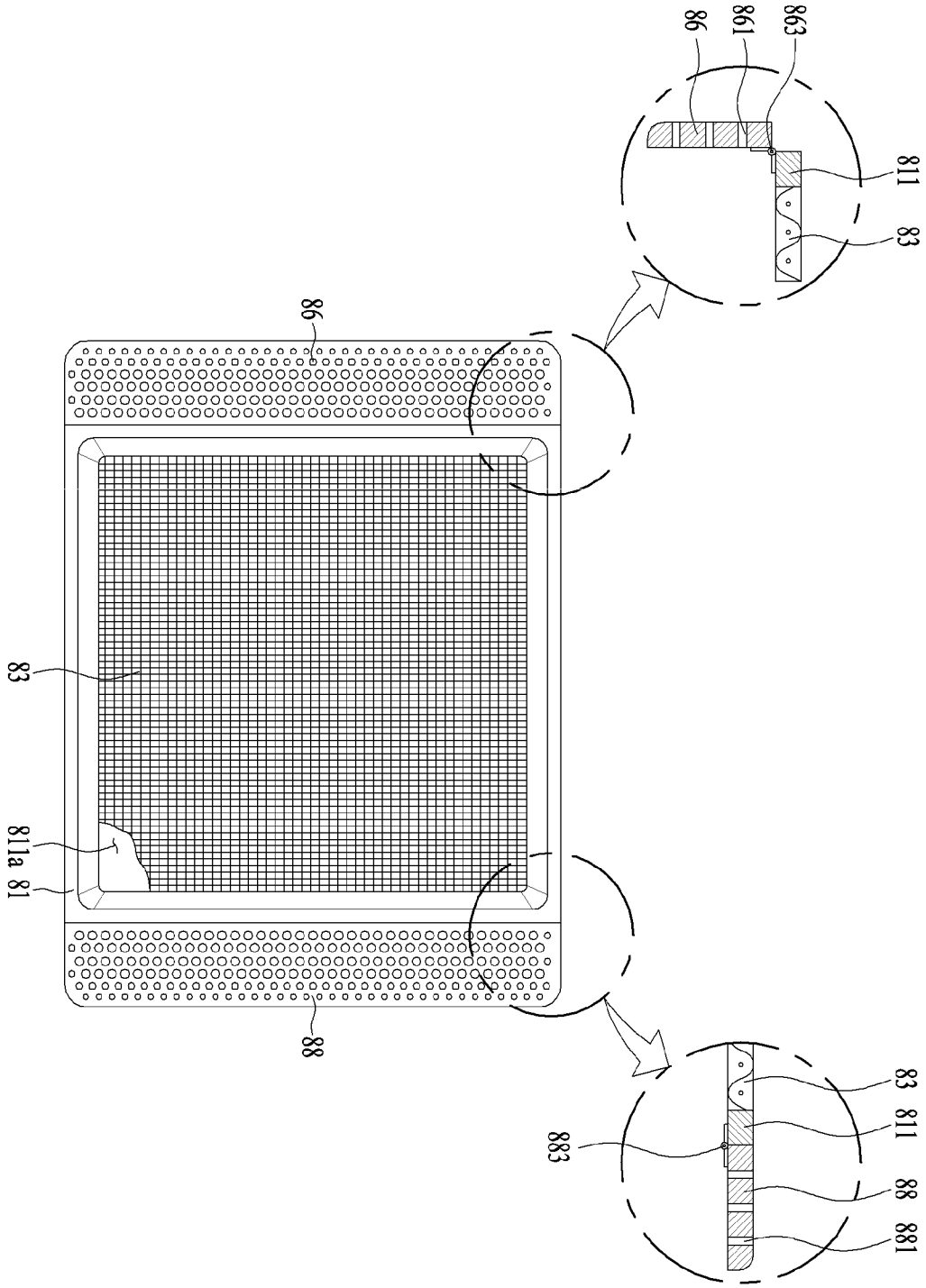

[Fig. 15]
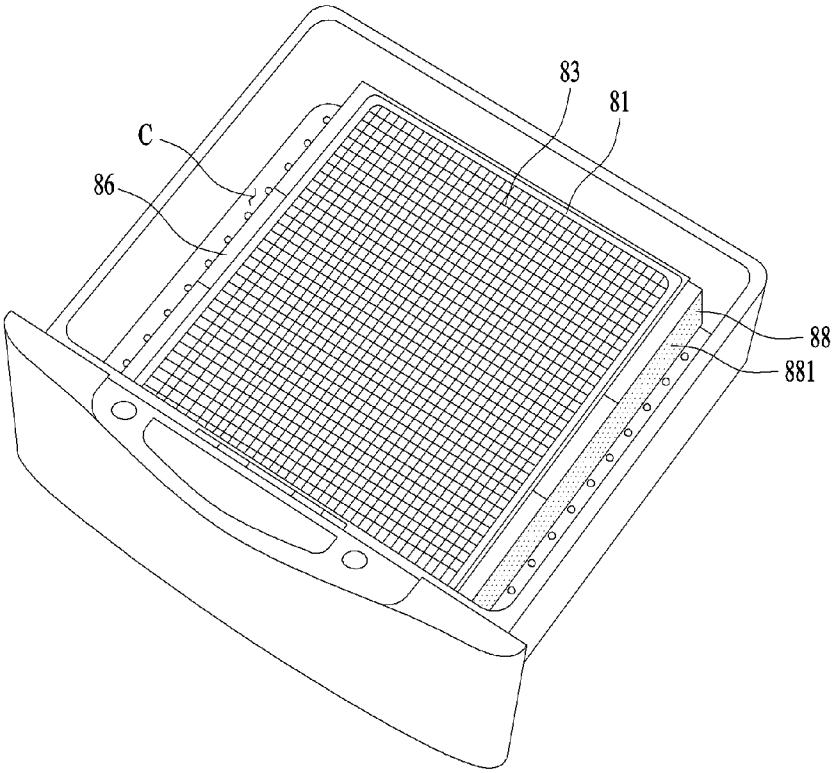

[Fig. 16]
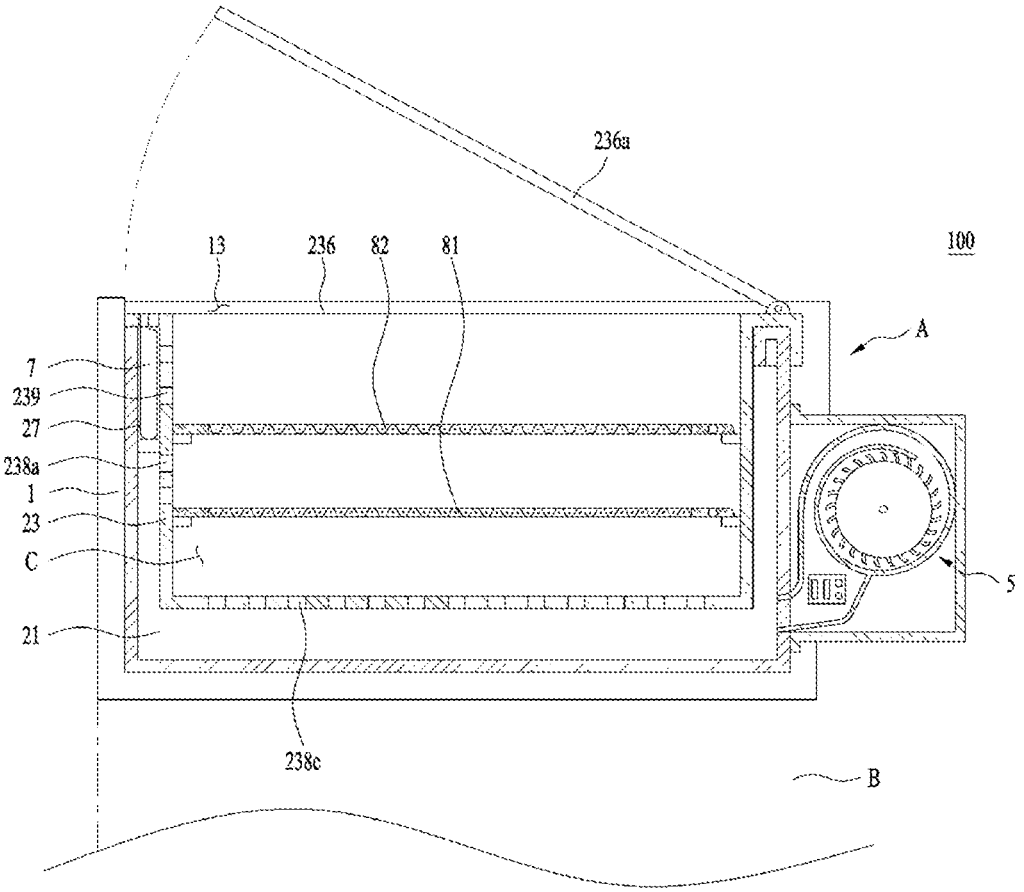

LAUNDRY TREATING APPARATUS

CROSS-REFERENCE TO RELATED APPLICATIONS

Pursuant to 35 U.S.C. § 119(a), this application claims the benefit of earlier filing date and right of priority to Korean Application No. 10-2017-0068997, filed on Jun. 2, 2017 in Korea, the entire contents of which is hereby incorporated by reference herein in its entirety.

BACKGROUND OF THE DISCLOSURE

Field of the Disclosure

Embodiments of the present disclosure relate to a laundry treating apparatus.

Discussion of the Related Art

Laundry treating apparatuses typically include electric appliances for washing wash-objects (for example, clothes), electric appliances for drying the moisture contained in wash-objects and electric appliances for performing both washing and drying of clothes.

Such a conventional laundry treating apparatus may include a drum for defining a predetermined space in which clothes to wash are loaded and stored; and an air supply unit for supplying heated air to the drum. The laundry treating apparatus having such a structure is configured to supply the heated air to clothes to remove moisture from the clothes, while agitating clothes by rotating the drum. However, the conventional laundry treating apparatus has a disadvantage of wrinkles which might remain on clothes, because it supplies the heated air while rotating the drum.

To overcome the disadvantage, some conventional laundry treating apparatuses provide a dry chamber for providing a drying space; a plurality of racks provided in the dry chamber and providing a predetermined space in which the clothes are arranged; and an air supply unit for supplying the heated air via a bottom surface of the dry chamber. The laundry treating apparatus including the racks is capable of minimizing the disadvantage of such wrinkles which might remain on the clothes. In case of supplying the heated air via the bottom surface of the dry chamber, dying efficiency is likely to become low disadvantageously.

SUMMARY OF THE DISCLOSURE

Embodiments of the present invention provide a laundry treating apparatus which has high drying efficiency.

Embodiments of the present invention also provide a laundry treating apparatus which includes a hinge unit capable of adjusting a rotation angle of one or more racks on which dry objects are disposed.

Embodiments of the present invention also provide a laundry treating apparatus including two dry spaces which are independently partitioned off.

Embodiments of the present disclosure also provide a laundry treating apparatus comprising an accommodating body comprising a bottom surface; a front surface extended from the bottom surface upward; a rear surface fixed to the bottom and facing the front surface; and first and second lateral surfaces connecting the front surface and the rear surface with each other; a dry chamber mounted in the accommodating body and comprising a chamber bottom; a chamber front; a chamber rear; chamber first and second sides which are spaced a preset distance apart from the bottom surface, the front surface, the rear surface and the first and second lateral surfaces; a rack provided in the dry chamber and providing a space in which dying objects are disposed; an air inlet hole penetrating the rear surface; an air supply unit for supplying heated air to a space formed between the accommodating body and the dry chamber via the air inlet hole; and an air supply hole penetrating the chamber front and allowing internal air of the accommodating body to be supplied to the dry chamber.

The rack may comprise a first rack provided distant from the chamber bottom and having a mesh on which the drying objects are put; and a second rack provided over the first rack and having a mesh on which the drying objects are put, and the air supply unit is located between the first rack and the second rack.

The air inlet hole may be provided lower than the chamber bottom.

The laundry treating apparatus may further comprise a path formation unit provided in a space formed between the front surface and the chamber front and guiding the air drawn into the space formed between the bottom surface and the chamber bottom toward the air supply hole.

The path formation unit may comprise a first guider projected from the chamber front toward the front surface along a longitudinal direction of the dry chamber and located adjacent to the air supply hole; and a second guider projected from the chamber front toward the front surface along a longitudinal direction of the dry chamber and located in opposite to the first guider with respect to the air supply hole provided there between.

The air inlet hole may be provided in a space formed between a region where the first guider is projected onto the rear surface and a region where the second guider is projected onto the rear surface.

The laundry treating apparatus may further comprise a chamber bottom through hole penetrating the chamber bottom and allowing the dry chamber and the accommodating body to communicate with each other.

The first guider and the second guider may be extended to the bottom surface.

The air supply hole may comprise a first air supply hole and a second supply hole which are spaced a preset distance apart from each other along a traverse direction of the chamber front, and the air inlet hole may comprise a first air inlet hole provided in a region where the first air supply hole is projected onto the rear surface and a second air inlet hole provided in a region where the second air supply hole is projected onto the rear surface, and the path formation unit may comprise a first path formation unit for guiding air toward the first air supply hole and a second path formation unit for guiding air toward the second air supply hole.

The first path formation unit may comprise a first guider and a second guider which are projected from the chamber front toward the front surface along a longitudinal direction of the dry chamber and provided in opposite with respect to the first air supply hole provided there between, and the second path formation unit may comprise a third guider and a fourth guider which are projected from the chamber front toward the front surface along the longitudinal direction of the dry chamber and provided in opposite with respect to the second air supply hole provided there between.

The first air inlet hole may be located in a space between a region where the first guider is projected onto the rear surface and a region where the second guider is projected onto the rear surface, and the second air inlet hole may be located in a space formed between a region where the third guider is projected onto the rear surface and a region where the fourth guider is projected onto the rear surface.

The laundry treating apparatus may further comprise a chamber bottom through hole penetrating the chamber bottom and allowing the dry chamber and the accommodating body to communicate with each other.

The laundry treating apparatus may further comprise an additive agent supply unit detachably provided between an outer circumferential surface of the dry chamber and an inner circumferential surface of the accommodating body and providing a space which accommodates an additive agent for supplying fragrance to the dry chamber; and an additive agent supply hole penetrating one of the chamber front, the chamber rear and the chamber first and second sides and allowing the fragrance exhausted from the additive agent supply unit to be drawn into the dry chamber.

The laundry treating apparatus may further comprise a first cabinet defining a space in which the accommodating body is mounted; an opening penetrating the first cabinet and formed toward the front surface; and a clothes-introduction opening provided in a top surface of the dry chamber and allowing the drying objects loaded and unloaded into or out of the dry chamber, wherein the accommodating body is retractable from the cabinet through the opening.

The laundry treating apparatus may further comprise a second cabinet disposed on a top surface of the first cabinet; a drum mounted in the second cabinet and defining a space in which clothes are held; a second cabinet opening provided in a predetermined portion of a space defined by the second cabinet toward the opening and penetrating a front surface of the second cabinet, in communication with the drum; and a second air supply unit for supplying heated air to the drum.

The laundry treating apparatus may further comprise a clothes-introduction opening provided in a top surface of the dry chamber and allowing the drying objects loaded and unloaded into or out of the dry chamber; and a door coupled to the first cabinet or the dry chamber and opening/closing the clothes-introduction opening.

The laundry treating apparatus may further comprise a second cabinet disposed underneath a bottom surface of the first cabinet; a drum mounted in the second cabinet and defining a space in which clothes are held; a second cabinet opening penetrating a front surface of the second cabinet, in communication with the drum; and a second air supply unit for supplying heated air to the drum.

According to the embodiments of the present disclosure, the laundry treating apparatus has high drying efficiency.

Furthermore, the laundry treating apparatus includes the hinge unit capable of adjusting a rotation angle of one or more racks on which dry objects are disposed.

Still further, the laundry treating apparatus includes two dry spaces which are independently partitioned off.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings:

FIG. 1 is a diagram illustrating one embodiment of a laundry treating apparatus in accordance with the present disclosure;

FIG. 2 is a diagram illustrating one embodiment of a second treating device provided in the laundry treating apparatus;

FIGS. 3 and 4 illustrate one embodiment of a first treating device and a second treating device which are provided in the laundry treating apparatus;

FIG. 5 illustrates one embodiment of a drawer which is provided in the laundry treating apparatus;

FIGS. 6, 7 and 8 illustrate one embodiment of a path formation unit which is provided in the laundry treating apparatus;

FIG. 9 illustrates one embodiment of an additive agent supply unit which is provided in the laundry treating apparatus;

FIGS. 10 and 11 illustrate one embodiment of one or more racks which are provided in the laundry treating apparatus;

FIG. 12 illustrates one embodiment of a hinge unit which is provided in the laundry treating apparatus;

FIG. 13 illustrates another embodiment of the first treating device;

FIGS. 14 and 15 illustrate another embodiment of the racks; and

FIG. 16 illustrates another embodiment of the laundry treating apparatus in accordance with the present disclosure.

DESCRIPTION OF SPECIFIC EMBODIMENTS

Preferred embodiments of the present invention will be described below in more detail with reference to the accompanying drawings. Elements and control methods of the present invention which are described as follows may, however, be embodied in different forms and should not be constructed as limited to the embodiments set forth herein. Description of a refrigerator will now be given in detail according to exemplary embodiments disclosed herein, with reference to the accompanying drawings. For the sake of brief description with reference to the drawings, the same or equivalent components may be provided with the same reference numbers, and description thereof will not be repeated.

The laundry treating apparatus in accordance with exemplary embodiments of the present disclosure may be configured of only a first treating device for drying dry objects (for example, clothes) or both the first treating device and a second treating device for drying or washing clothes. FIG. 1 illustrates one embodiment of the laundry treating apparatus including the first treating device (A) for drying clothes; and the second treating device (B) disposed on a top of the first treating apparatus.

As shown in FIG. 1, the first treating apparatus (A) may include a first cabinet 1 having an opening 11 which is formed in a front surface; a drawer 2 retractable from the first cabinet via the opening 11; a dry chamber (C) provided in the drawer and defining a dry space; and a first air supply unit 5 for supplying heated air to the dry chamber (C).

Meanwhile, the second treating device (B) may be provided as a dryer for drying clothes or a washer for washing clothes. FIG. 2 illustrates one embodiment of the second treating device (B) provided as a dryer. In this instance, the second treating device (B) may include a second cabinet 41 disposed on a top of the first cabinet 1; a drum 42 provided in the second cabinet 41 and holding clothes therein; and a second air supply unit 461, 463, 467 and 468 for drying the clothes by supplying heated-air to the drum.

A second cabinet opening 411 is provided in one surface of the second cabinet 41 toward a direction of the opening 11 formed in the first cabinet (a front surface of the second cabinet) and the second cabinet opening is open and closed by the second cabinet door 413.

The drum 42 may include a cylindrical hollow drum body 421. A front surface of the drum body 421 is rotatably supported to a first support 422 fixed in the second cabinet 41 and a rear surface is rotatably supported to a second support 426 fixed in the second cabinet 41. A drum opening 423 is provided in the first support 422 to make the second cabinet opening 411 communicate with an internal space of the drum body 421.

The second air supply unit may include an air inlet duct 461 for guiding air into the drum body 421; an air outlet duct 463 for guiding the internal air of the drum body 421 outside the second cabinet 41; a heating unit 468 provided in the air inlet duct 461 to heat air; and a second treating device impeller 467 for moving the internal air of the drum body 421 to the air outlet duct 463. The air outlet duct 461 is in communication with the drum body 421 via an air inlet hole 427 provided in the second support and the air outlet duct 463 is in communication with the drum body 421 via an air outlet hole 425 provided in the first support.

The drum body 421 and the second treating device impeller 467 are rotary by a drive unit. The drive unit may be provided as a drum motor 441. A pulley 445 is fixed to one end of a drum motor shaft 4443 provided in the drum motor 441 and the second treating impeller 467 is fixed to the other end of the drum motor shaft 443. In this instance, the rotational force of the pulley 445 is configured to be transferred to the drum body 421 via a belt 447.

Referring to FIG. 3, the first treating device (A) will be described. The drawer 2 shown in FIG. 3 may include an accommodating body 21 retractable from the first cabinet 1 through the opening 11; and a chamber body 23 fixedly mounted in the accommodating body 21 and having a dry chamber (C) defined therein.

A panel 29 may be fixed to a front surface of the accommodating body 21. The panel 29 may be formed in a predetermined shape configured to close the opening 11 when the accommodating body 21 is inserted in the first cabinet 1.

Even in a state where the accommodating body 21 is inserted in the first cabinet 1, the panel 29 may be located outside the cabinet 1 and a control panel 291 may be then provided in the panel 29. FIG. 3 illustrates one embodiment disclosing that the control panel 291 is provided in an upper surface of the panel. The control panel 291 may include an input unit 291*a* and a display unit 291*b*. The display unit 291*b* is provided as means for displaying control commands which are selectable by a user and a process of implementing the control commands. The input unit 291*a* is provided as means for inputting the control commands to the first treating device (A).

A flow path is provided between an inner circumferential surface of the accommodating body 21 and an outer circumferential surface of the chamber body 23 to guide the air supplied by the first air supply unit 5 to the dry chamber (C). As shown in FIG. 4, the accommodating body 21 may include a bottom surface 211; a front surface 212 extended upwards from the bottom surface; a rear surface fixed to the bottom surface, facing the front surface; and first and lateral surfaces fixed to the bottom surface and connecting the front surface and the rear surface 213 with each other. An open surface 216 having the chamber body 23 inserted therein may be provided in a top surface of the accommodating body 21.

FIG. 4 illustrates that the accommodating body 21 is hexagonal shape with an open top surface 216. However, the shape of the accommodating body 21 is not necessarily hexagonal. Only if a through-hole may be provided in the top surface or the top surface is provided as an open top surface 216, the accommodating body 21 may be formed in diverse shapes.

An air inlet hole (217, a first air inlet hole) for supplying air to an internal air of the accommodating body from the first air supply unit 5 is provided in the accommodating body 21. The air inlet hole 217 may be provided to penetrate at least one of the front, rear and first and second lateral surfaces 212, 213, 214 and 215.

The chamber body 23 includes the dry chamber (C) defining a drying space; a clothes-introduction opening 236 provided in a top surface of the dry chamber and introducing clothes into the dry chamber (C); and a fixing unit 237 for fixing the dry chamber (C) to the accommodating body 21.

The dry chamber (C) may be defined by a chamber bottom 231, a chamber front 232, a chamber rear 233 and chamber first and second sides 234 and 235 which are provided in the internal space of the accommodating body 21.

The chamber bottom 231, the chamber front 232, the chamber rear 233 and the chamber first and second sides 234 and 235 may be located to face the bottom surface 211, the front surface 212, the rear surface 213 and the first and second lateral surfaces 214 and 215 of the accommodating body, respectively. In other words, the chamber front 232 may be located to face the front surface 212 of the accommodating body and the chamber rear 233 may be located to face the rear surface 213. The chamber first and second sides 234 and 235 may be located to face the first and second lateral surfaces 214 and 215, respectively.

The fixing unit 237 may be provided as a plate which is projected in a direction getting farther from the clothes-introduction opening 236 from an edge of the opening 236. As an alternative example, it may be provided as a groove for receiving an upper end of the accommodating body. The chamber front 232 is kept distant from the front surface 212 and the chamber rear 233 is kept distant from the rear surface 235 and the chamber first and second sides 234 and 235 are kept distant from the first and second lateral surfaces 214 and 215 by the fixing unit 237.

The chamber bottom 231 is fixed to the chamber front, the chamber rear and the chamber first and second sides, to be located over the bottom surface 211. It is preferred that the chamber bottom 231 is spaced apart from the bottom surface 211 of the accommodating body 21. That is to form a flow path of the air supplied via the air inlet hole 217 toward the chamber front 232.

An air supply hole (238*a*, a first air supply hole) for supplying the air drawn into the accommodating body 21 into the dry chamber (C) is provided in the chamber body 23. The air supply hole 238*a* may be provided to penetrate at least one of the chamber front 232, the chamber rear 213, the chamber first side 234 and the chamber second side 235.

As shown in FIG. 1, one or more racks may be provided in the dry chamber (C) to provide a predetermined space in which clothes are disposed. The racks may include a first rack 81 spaced apart from the chamber bottom 231; and a second rack 82 located over the first rack 81 to be distant from the first rack 81. The first rack 81 may include a frame 811 supported to an inner circumferential surface of the dry chamber (C); a mesh 813 disposed in a frame penetrating hole of the frame. The second rack 82 may also include a frame 821 and a mesh 823 and the specific structure of the first and second racks will be described later.

The first air supply unit 5 may be fixed to the rear surface 213 of the accommodating body 21 to be located outside the space defined by the accommodating body 21. The first air supply unit 5 may include a housing 51 for guiding air to the air inlet hole 217; a fan provided in the housing 51 and blowing air toward the air inlet hole 217; and a heater (57, a first heater) provided in the housing 51 and heating air.

The fan may include an impeller (53, a first impeller) rotatably mounted in the housing 51; and a motor 55 having a shaft 551 for rotating the impeller 53. Accordingly, when the impeller 53 is rotated by the shaft 551, the air supplied to the first cabinet 1 via the through hole 15 or the opening 11 provided in the rear surface of the first cabinet may flow toward the air inlet hole 217 along the housing 51. The air is heated by the heater 57 during the flow.

It is preferred that the air inlet hole 217 provided in the accommodating body 21 and the air supply hole 238*a* provided in the dry chamber (C) are located in the reverse directions. In other words, as shown in FIGS. 4 and 5, the air inlet hole 217 is provided in the rear surface 213 of the accommodating body and the air supply hole 238*a* is provided in the chamber front 232. That is to make it earlier to start the heat exchange between the air and the clothes held in the dry chamber (C).

If the air inlet hole 217 and the air supply hole 238*a* are provided in one surface of the accommodating body and one surface of the chamber body which face each other in one direction, respectively, (the air inlet hole is provided in the rear surface and the air supply hole is provided in the chamber rear), the hot air supplied via the air inlet hole 217 could be directly drawn into the dry chamber (C) via the air supply hole 238*a*. However, the heat exchange between the heated air and the clothes start when the temperatures of the dry chamber and the accommodating body are higher than the temperature of the clothes. The clothes held in the dry chamber (C) is likely to interfere with the air which flows to contact with the dry chamber (C) or the accommodating body 21. If the air inlet hole 217 and the air supply hole 238*a* are provided in the surfaces which face each other, respectively, the drying time might increase disadvantageously.

To solve the disadvantage of the increased drying time, the air inlet hole 217 and the air supply hole 238*a* are located in one surface of the accommodating body and one surface of the dry chamber which are located in the reverse direction. When the flow path is designed for the air supplied from the first air supply unit 5 to flow to the space formed between the accommodating body 21 and the chamber body 23 and then to the dry chamber (C), the accommodating body 21 and the chamber body 23 are able to be heated quickly and the time taken to start the heat exchange between the clothes and the air is able to be shortened.

Accordingly, it is preferred that the air inlet hole 217 may be provided in the rear surface 213 of the accommodating body and that the air supply hole 238*a* is provided in the chamber front 232. As one alternative example, the air inlet hole 217 is provided in the front surface 212 of the accommodating body and the air supply hole 238*a* is provided in the chamber rear 233. As another alternative example, the air inlet hole 217 may be provided in the first lateral surface 214 and the air supply hole 238*a* may be provided in the chamber second side 235.

In case the racks include the first rack 81 and the second rack 82 which are sequentially arranged along a longitudinal direction of the dry chamber (C) as shown in FIG. 1, the air supply hole 238*a* may be provided to supply the air to a space defined between the first rack 81 and the second rack 82 to dry the clothes.

In a drying method of the conventional dryer having one or more racks, the heated air is supplied to a space formed between the first rack 81 and the chamber bottom 231 and the air drawn into the dry chamber (C) passes the first rack 81 and the second rack 82 sequentially only to dry the clothes through the process.

According to the drying method mentioned above, the air blown between the first rack 81 and the chamber bottom 231 is supplied to the clothes disposed on the first rack 81 via the mesh 813 and exchanges heat with the clothes. The air having heat-exchanged with the clothes disposed on the first rack 81 has to be re-supplied to the clothes disposed on the second rack 82 after passing the mesh 823. However, it is confirmed that the air having heat-exchanged with the clothes disposed on the first rack tends to flow to the clothes-introduction opening 236 of the dry chamber through a gap formed between an edge of the second rack 82 and the inner circumferential surface of the dry chamber (C), not flow to the clothes disposed on the second rack 82 through the mesh 823. The resistance against the path toward the clothes-introduction opening 236 through the mesh 823 of the second rack 82 is larger than the resistance against the path toward the opening 236 through the end of the second rack 82. Such phenomenon is not so different from a configuration for exhausting the air having certain energy heat-exchangeable with the clothes outside the dry chamber (C), so that the conventional drying efficiency has some disadvantages of the low drying efficiency, the increased drying time and the wasted energy.

The disadvantages may be solved by locating the air supply hole 238*a* between the first rack 81 and the second rack 82. More specifically, when the heated air is drawn into the space formed between the first rack 81 and the second rack 82, it means that air with a larger energy is supplied to the first rack 81 and the second rack 82 simultaneously so that most of the air may be supplied to the clothes, in spite of the flow resistance of the mesh 238*a*. Based on experiments, it is confirmed that drying efficiency is improved by 10% or more by locating the air supply hole 238*a* between the first rack 81 and the second rack 82.

Meanwhile, to minimize the energy loss of the air supplied to the air supply hole 238*a* (in other words, to minimize the flow resistance of the air flow path formed between the air inlet hole and the air supply hole) it is preferred that the air inlet hole 217 is provided in a space which is formed between the chamber bottom 231 and the bottom surface 211 in the space defined by the rear surface 213. Moreover, the first treating device (A) may further include a path formation unit 25 for guiding the air drawn into the space between the bottom surface 211 and the chamber bottom 231 toward the air supply hole 238*a*. It is preferred that the path formation unit 25 is provided between the space formed between the front surface 212 and the chamber front 232.

As shown in FIGS. 6 and 7, the path formation unit may include a first guider 251 and a second guider 253 which face each other, with the air supply hole 238*a* located there between (see FIG. 6). The first guider 251 and the second guider 253 may be provided as plates projected from the chamber front 232 toward the front surface 212 of the accommodating body and they may be arranged along a longitudinal direction of the dry chamber (C) (see FIG. 7).

To minimize the motion energy loss of the air supplied to the accommodating body 21 via the air inlet, it is preferred that the air inlet hole 217 is provided in a space (R1) formed between a region of the rear surface 213 where the first guider 251 is projected and a region where the second guider 253 is projected. A diameter (L2) of the air inlet hole 217 may be a distance (L1) or less between the first guider and the second guider (see FIG. 7).

The first guider 251 and the second guider 253 may be provided with a predetermined length (H1) not out of the chamber front 232 or extended to the bottom surface 211 of the accommodating body by another length (H2), so as to move the air drawn into the accommodating body 21 via the air inlet hole 217 to the air supply hole 238*a* quickly.

Moreover, it is preferred that the air supply hole 238*a* is provided in a center of the chamber front 232 in a traverse direction. If the air supply hole 238*a* is provided in the traverse-direction center of the chamber front 232, air circulation (F1 and F2) may be formed in the entire internal space of the dry chamber (C) and the drying efficiency can be then improved.

As shown in FIG. 8, the air supply hole for supplying air to the dry chamber (C) may include a first air supply hole and a second air supply hole which are distant from each other along a traverse direction of the chamber front 232. In this instance, the air inlet hole provided in the accommodating body 21 has to include a first air inlet hole 217 and a second air inlet hole 213. The first air inlet hole 217

The first air supply hole 238*a* and the second air supply hole 238*b* may be provided in positions opposite to each other with respect to the traverse-direction center of the chamber front 232, so that the circulation may facilitate the uniform supply of the air to the dry chamber (C).

To supply the heated air to the first and second inlet holes 217 and 219, respectively, the first air supply unit 5 may include a first impeller 53 fixed to one end of the motor shaft 551 and moving air toward the first air inlet hole; a second impeller 54 fixed to the other end of the motor shaft 551 and moving air toward the second air inlet hole; a first heater 57 disposed between the first impeller and the first inlet hole; and a second heater 58 disposed between the second impeller 54 and the second air inlet hole 219.

The path formation unit may include a first path formation unit 251 and 253 for guiding air toward the first air supply hole 238*a*; and a second path formation unit 255 and 257 for guiding air toward the second air supply hole 238*b*.

The first path formation unit may include a first guider 251 and a second guider 253 which face each other with respect to the first air supply hole 238*a* located there between. The second path formation unit may include a third guider 255 and a fourth guider 257 which face each other with respect to the second air supply hole 238*b* located there between.

The first guider 251, the second guider 253, the third guider 255 and the fourth guider 257 may be provided as plates projected from the chamber front 232 toward the front surface 212 of the accommodating body along a longitudinal direction of the dry chamber (C).

In this instance, the first air inlet hole 217 may be located in a space (R1) which is formed between a region where the first guider is projected onto the rear surface and a region where the second guider is projected onto the rear surface. The second air inlet hole 219 may be located in a space (R2) which is formed between a region where the third guider is projected onto the rear surface and a region where the fourth guider is projected onto the rear surface.

A diameter of the first air inlet hole 217 may be set as a distance (L1) or less between the first guider and the second guider and a diameter of the second air inlet hole may be set as a distance or less between the third guider and the fourth guider.

As shown in FIG. 7, the first treating device (A) in accordance with the present disclosure may further include a chamber bottom through hole 238*c* penetrating the chamber bottom 231 to make the dry chamber (C) and the accommodating body 21 communicate with each other. According to experiments, the drying efficiency can be improved by the chamber bottom 238*c*.

The first treating device (A) shown in FIG. 1 may further include an additive agent supply unit 7 for supplying an additive agent to the dry chamber (C). The additive agent mentioned in the present disclosure means a material for supplying fragrance to the clothes or eliminating bad smell from the clothes. Examples of the additive agent include a sheet-type fragrance.

The additive agent supply unit 7 may be detachably provided in the space formed between the outer circumferential surface of the dry chamber (C) and the inner circumferential surface of the accommodating body 21. FIG. 1 illustrates one embodiment disclosing the additive agent supply unit 7 which is detachably secured to a securing unit 27 provided between the chamber front 232 and the front surface 212.

As shown in FIG. 4, the securing unit 27 may include a case accommodating portion 271 provided in the chamber front 232; and an insert hole 273 penetrating the chamber body 23 to make the case accommodating portion 271 communicate with the outside. The insert hole 273 may be provided to penetrate the fixing unit 237 provided in the chamber body.

In this instance. The first guider 251 and the second guider 253 may be extended from a bottom surface of the case accommodating portion 271 to the chamber bottom 231 or the bottom surface 211 along a longitudinal direction of the dry chamber (C).

Meanwhile, the case accommodating portion 271 may be configured to communicate with the dry chamber (C) via an additive agent supply hole 239 penetrating the chamber front 232. Although not shown in the drawings, a through-hole may be further provided in the bottom surface of the case accommodating portion 271 to suck air into the case accommodating portion 271, so that the additive agent can be supplied to the dry chamber (C) more effectively.

As shown in FIG. 9, the additive agent supply unit 7 may include a first case 71 and a second case 73 which are formed in a shape insertable in the case accommodating portion 271 to provide some space accommodating the additive agent 78.

The first case 71 and the second case 73 may be coupled to each other by using a hinge 75. The first case 71 may include a first hole 731 and a second hole 732 provided to make the space accommodating the additive agent 78 communicate with the outside.

The first hole 731 and the second hole 732 are able to be open and closed by a hole opening/closing unit 77. The hole opening/closing unit 77 may include a plate 771 capable of reciprocating in the first and second cases 71 and 73; a plate through hole 773 penetrating the plate; and a handle 775 fixed to the plate.

The handle 775 is exposed outside the first case 71 after inserted in the slit 735 provided along the traverse direction of the first case 71, so that the user can move the handle 775 along the slit 735 horizontally.

The first hole 731, the second hole 732 and the plate through hole 773 are formed in the same shape. In case the width of the plate 771 is equal to the maximum distance between the first and second holes 731 and 732, with the same shape, the plate through hole 773 is located between the first and second holes 731 and 732 and the first and second holes 731 and 732 is then capable of keeping a closed state by the plate 771. However, when the first hole is overlapped with the plate through hole 773 by the user's moving of the handle 775 in a direction toward the first hole, the first and second holes 731 and 732 are in a closed state.

Accordingly, the user who tries to supply fragrance to the clothes or remove bad smell from the clothes has to open and the first and second holes 731 and 732 and then couple the additive agent supply unit 7 to the case accommodating portion 271.

FIG. 10 illustrates one embodiment of the racks provided in the laundry treating apparatus in accordance with the present disclosure. The first rack 81 includes a frame 811; a frame through hole 811*a* penetrating the frame; and a mesh 813 located in the frame through hole, in a state of being fixed to the frame. As shown in FIG. 11, the frame through hole 811*a* may include a plurality of bars 814 spaced apart a preset distance from each other.

The second rack 82 may be provided in the same structure as the first rack 81. In other words, the second rack 82 may also include a frame 821; a frame through hole 821*a*; and a mesh 823 or a plurality of bars 824 provided n the frame through hole 821*a*.

As shown in FIG. 1, the first rack 81 and the second rack 82 are rotatably coupled to the dry chamber (C) by using a hinge unit 9. More specifically, the first rack 81 may be fixed in the dry chamber (C) by the front support 241 and a first hinge unit 9*a*. The second rack 82 may be fixed in the dry chamber (C) by the second front support 245 and a second hinge unit 9*b*.

The first front support 241 is provided in the chamber front 232 as means for supporting one end of the frame 811 of the first rack 81. The second front support 243 is provided in the chamber front 232 as means for supporting one end of the frame 821 of the second rack. The second front support 243 is located higher than the first front support 241.

The first rack 81 is rotatably arranged in the dry chamber (C) by the first hinge unit 9*a* and the second rack 82 is rotatably arranged in the dry chamber (C) by the second hinge unit 9*b*.

The reason why the second rack 82 is rotary by the second hinge unit 9*b* is to facilitate the user's putting of the clothes on the first rack or taking the clothes put on the first rack out of the dry chamber (C) and the reason why the first rack is rotary by the first hinge unit 9*a* is to facilitate the user's separating of the first rack 81 from the first hinge unit 9*a*, which will be described in detail later.

The first hinge unit for coupling the first rack 81 in the dry chamber (C) has the same structure as the second hinge unit for coupling the second rack 82 in the dry chamber (C). as shown in FIG. 4, each of the first and second hinge units may include a rack shaft 911 provided to penetrate the dry chamber (C) and forming a rotational center of each frame 811 and 821; a first operation body 91 located outside the dry chamber and rotatable by the rack shaft 911; a stopper body 95 located outside the dry chamber (C) and including a first stopper 955 and a second stopper 957; and a second operation body 93 rotatable between the first stopper 955 and the second stopper 957. The second operation body 93 is configured to rotate in the reverse direction with respect to the rotation direction of the first operation body 91 by contacting with the first operation body 91 when the first operation body 91 is rotating.

As shown in FIG. 12 (b), the stopper body 95 may include a first base 951 and a second base 953 which form a predetermined space (or an accommodating portion) accommodating the second operation body 93, together with the first stopper 955 and the second stopper 957.

An elastic force providing unit 98 is provided in the accommodating portion to provide an elastic force to the second operation body 93. The elastic force providing unit 98 may include a coupling portion 981 coupled to the stopper body 95; a supporting portion 983 capable of reciprocating in the accommodating portion; an operation body shaft 984 provided in the supporting portion 983 and having the second operation body 93 rotatably coupled thereto; and a connecting portion 985 connecting the coupling portion 981 and the supporting portion 983 with each other and providing an elastic force to the supporting portion 983.

The operation body shaft 984 is coupled to the second operation body 93 via coupling hole 931 provided in the second operation body 93.

In case the coupling portion 981, the supporting portion 983 and the connecting portion 985 are made of the same material, the connecting portion 985 has a smaller width than the coupling portion 981 and the supporting portion 983, to provide the elastic force to the supporting portion. Alternatively, the connecting portion 985 may be a spring.

Meanwhile, the first rack 81 may be detachably coupled to the rack shaft 911 of the first hinge unit 9*a* and the second rack 82 may be detachably coupled to the rack shaft 911 of the second hinge unit 9*b*.

For that, a shaft coupling portion 815 and 825 may be further provided in each of the first and second racks. As shown in FIG. 10, the shaft coupling portion may include a first groove 815*a* and 825*a* extended along a longitudinal direction of the frame 811 and 821 and providing a path along which the rack shaft 911 moves; and a second groove 815*b* and 825*b* extended toward the front of the frame 811 and 821 and providing a path along which the rack shaft 911 moves.

The user is able to separate each of the racks from the dry chamber (C), when pulling each of the racks in a direction getting farther from the dry chamber (C) after rotating the first and second racks toward the opening. Accordingly, the user is able to take the racks 81 and 82 out of the dry chamber (C) when trying to wash and clean the internal space of the dry chamber (C) or dry the drying objects with a large volume.

An operation process of the hinge unit 9 having the structure mentioned above is shown in FIG. 12. FIG. 12(*a*) illustrates that the first rack 81 and the second rack 82 are coupled to the front support 241 and the second front support 243, respectively. In this state, the user rotates the first rack or the second rack and then the first operation body 91 is rotated by the rack shaft 911.

When the first operation body 91 is rotated to a preset first angle (A1) a free end of the first operation body 91 is connected to the second operation body 93. The second operation body 93 keeps a state of being pressed toward the first operation body 93 by the elastic force providing unit 98. Accordingly, once the first operation body 91 is coupled to the second operation body 93, the first rack 81 and the second rack 82 are capable of keeping a state of being rotated to a first angle. When the second rack 82 keeps a state of being rotated to the first angle (A1), it is easy for the user to load clothes on the first rack or unload the clothes put on the first rack out of the dry chamber.

Meanwhile, the maximum counter-clockwise rotation angle of the second operation body 93 is limited by the second stopper 957 and that of the second operation body 93 is limited by the first stopper 955. When the first or second rack is rotated to a second angle (A2) preset to be larger than the first angle (A1), the second operation body 93 contacts with the second stopper 957 and the corresponding rack maintains a state of being rotated to the second angle (A2).

When the first rack 81 and the second rack 82 maintain the state of being rotated to the second angle (A2), the user is able to couple or decouple the first rack 81 and the second rack 82 to or from the dry chamber (C) conveniently.

As shown in FIGS. 10 and 11, each of the frames provided in the racks may further include a curbed portion 811*b* and 821*b*. one surface of the frame having the rack shaft 911 coupled thereto is curved in a direction getting farther from the inner surface of the dry chamber (C) to form the curved portion 811*ab* and 821*b*. the curved portion 811*b* and 821*b* serves as means for allowing the two spaces partitioned off by the racks 81 and 82 (in other words, the space located over the frame and the space located under the frame) to communicate with each other.

Drying objects such as clothes have to be hung or put on the racks 81 and 82, in a state where they are unfolded, to minimize the drying time. The curved portions 811*b* and 821*b* serve as means for allowing the clothes to be hung or put on the racks without being folded. When the curved portions 811*b* and 821*b* are provided in the frames 811 and 821, respectively, some long drying objects such as long sleeved tops are allowed to move to the space located under the racks 81 and 82 so that the user can put or hang the long clothes on the racks, without folding them.

FIG. 13 illustrates another embodiment of the first treating device (A). In the illustrated embodiment, the first rack 81 provided in the first treating device (A) is supported in the dry chamber (C) by the first front support 241 and the first rear support 242 and the second rack 82 is supported in the dry chamber (C) by the second front support 243 and the second rear support 244.

In this instance, the first rack and the second rack are provided as shown in FIG. 14. Each of the racks shown in FIG. 14 includes a mesh 83 or bar provided in the frame through hole; and a first rotary plate 86 and a second rotary plate 88 provided in both lateral surfaces of the frame 81.

The first rotary plate 86 is rotatably coupled to the frame 81 by using a first hinge 863. A plurality of first rotary plate through holes 861 may be provided in the first rotary plate 86. The second rotary plate 88 may also include a plurality of second rotary plate through holes; and a second hinge 883.

The user is able to fold the first rotary plate 86 and the second rotary plate 88 of the racks having the structure mentioned above, if necessary. Accordingly, such the rotary plates may realize the same effect of the curved portions mentioned above.

FIG. 16 illustrates one embodiment of the laundry treating apparatus including the first treating device (A) which is disposed on the top of the second treating device (B). In this embodiment, the second treating device (B) is provided with the same structure as the second treating device (B) shown in FIG. 2.

The first treating device (A) of this embodiment may further include a through hole 13 penetrating the top surface thereof; and a door 236*a* coupled to the first cabinet 1 or the drawer 2 and opening/closing the clothes-introduction opening 236 of the dry chamber (C).

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus comprising:

a first cabinet that defines an opening at a front side;

an accommodating body configured to be inserted into and withdrawn from the first cabinet through the opening, the accommodating body including:

a bottom surface, a front surface extending upward from the bottom surface, a rear surface that is fixed to the bottom surface, that faces the front surface, and that defines at least one air inlet hole, and first and second lateral surfaces connecting the front surface and the rear surface;

a dry chamber body that is inserted in the accommodating body, that defines a dry chamber, and that is spaced apart from an inner surface of the accommodating body by a preset distance, the dry chamber body including:

a chamber bottom configured to face the bottom surface of the accommodating body, a chamber front configured to face the front surface of the accommodating body, the chamber front defining at least one air supply hole that allows flow of air from the accommodating body to the dry chamber, a chamber rear configured to face the rear surface of the accommodating body, a chamber first side and a chamber second side that connect the chamber front and the chamber rear to each other and that are configured to face the first lateral surface and the second lateral surface of the accommodating body, respectively, and a top surface that defines a clothes-introduction opening that allows loading of objects to the dry chamber and unloading of the objects from the dry chamber;

at least one rack provided in the dry chamber and configured to receive the objects to be dried; and an air supply unit configured to supply heated air through the air inlet hole toward a space defined between the accommodating body and the dry chamber body.

2. The laundry treating apparatus of claim 1, wherein the rack comprises:

a first rack spaced apart from the chamber bottom, the first rack including a first mesh configured to receive the objects; and a second rack disposed vertically above the first rack and spaced apart from the first rack, the second rack including a second mesh configured to receive the objects, and wherein the air supply hole is located between the first rack and the second rack.

3. The laundry treating apparatus of claim 2, wherein the air inlet hole is positioned vertically lower than the chamber bottom.

4. The laundry treating apparatus of claim 2, further comprising:

at least one path formation unit provided between the chamber front and the front surface of the accommodating body and configured to guide the heated air toward the air supply hole.

5. The laundry treating apparatus of claim 4, wherein the path formation unit comprises:

a first guider that protrudes from the chamber front toward the front surface of the accommodating body; and a second guider that protrudes from the chamber front toward the front surface of the accommodating body and that is spaced apart from the first guider, and wherein the air supply hole is defined at a portion of the chamber front between the first and second guiders.

6. The laundry treating apparatus of claim 5, wherein the air inlet hole is defined at an area of the rear surface of the accommodating body that faces toward the portion of the chamber front between the first and second guiders.

7. The laundry treating apparatus of claim 6, further comprising a chamber bottom through hole that is defined at the chamber bottom and configured to communicate air between the dry chamber and the accommodating body.

8. The laundry treating apparatus of claim 5, wherein the first guider and the second guider extend toward the bottom surface of the accommodating body.

9. The laundry treating apparatus of claim 4, wherein the air supply hole includes a first air supply hole and a second air supply hole that is spaced from the first air supply hole by a predetermined distance along a traverse direction of the chamber front, wherein the air inlet hole includes a first air inlet hole facing toward the first air supply hole and a second air inlet hole facing toward the second air supply hole, and wherein the path formation unit includes a first path formation unit configured to guide air toward the first air supply hole and a second path formation unit that is spaced apart from the first path formation unit in the traverse direction and configured to guide air toward the second air supply hole.

10. The laundry treating apparatus of claim 9, wherein the first path formation unit comprises first and second guiders that protrude from the chamber front toward the front surface of the accommodating body, wherein the second path formation unit comprises third and fourth guiders that protrude from the chamber front toward the front surface of the accommodating body, wherein the first air supply hole is defined at a first portion of the chamber front between the first and second guiders, and wherein the second air supply hole is defined at a second portion of the chamber front between the third and fourth guiders.

11. The laundry treating apparatus of claim 10, wherein the first air inlet hole is defined at a first area of the rear surface of the accommodating body that faces toward the first portion of the chamber front between the first and second guiders, and wherein the second air inlet hole is defined at a second area of the rear surface of the accommodating body that faces toward the second portion of the chamber front between the third and fourth guiders.

12. The laundry treating apparatus of claim 1, further comprising:

an additive agent supply unit detachably provided between an outer surface of the dry chamber and an inner surface of the accommodating body, the additive agent supply unit being configured to accommodate an additive agent that supplies fragrance to the dry chamber; and an additive agent supply hole defined in at least one of the chamber front, the chamber rear, the chamber first side, or the chamber second side, the additive agent supply hole being configured to communicate the fragrance of the additive agent between the additive agent supply unit and the dry chamber.

13. The laundry treating apparatus of claim 1, wherein the air supply unit is positioned rearward of the chamber rear within the first cabinet.

14. The laundry treating apparatus of claim 1, further comprising:

a second cabinet disposed vertically above a top surface of the first cabinet;

a drum mounted in the second cabinet and configured to receive clothes;

a second cabinet opening defined at a front surface of the second cabinet and configured to communicate with the drum; and a second air supply hole configured to supply second heated air to the drum.

15. The laundry treating apparatus of claim 1, further comprising:

a door coupled to the first cabinet or to the dry chamber body, the door being configured to open and close the clothes-introduction opening.

16. The laundry treating apparatus of claim 15, further comprising:

a second cabinet disposed vertically below a bottom surface of the first cabinet;

a drum mounted in the second cabinet and configured to receive clothes;

a second cabinet opening defined at a front surface of the second cabinet and configured to communicate with the drum; and a second air supply unit configured to supply second heated air to the drum.

17. The laundry treating apparatus of claim 1, further comprising a hinge unit that is located at at least one of the chamber first side or the chamber second side, wherein the rack is coupled to the dry chamber body and configured to rotate about the hinge unit.

18. The laundry treating apparatus of claim 17, wherein the dry chamber body further includes a front support that protrudes from the chamber front, that extends along a traverse direction of the chamber front, and that is configured to seat the rack.

19. The laundry treating apparatus of claim 1, wherein the accommodating body defines an open top surface that is configured to receive the dry chamber body.

20. The laundry treating apparatus of claim 1, wherein the air supply hole is configured to receive air from a space defined between the chamber front and the front surface of the accommodating body.

* * * * *